US006309120B1

(12) United States Patent
Kasahara

(10) Patent No.: US 6,309,120 B1
(45) Date of Patent: Oct. 30, 2001

(54) PRINTER HAVING STACKER

(75) Inventor: Yoshihiro Kasahara, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/249,318

(22) Filed: Feb. 12, 1999

(30) Foreign Application Priority Data

Feb. 16, 1998 (JP) ..... 10-050055

(51) Int. Cl.[7] ..... B41J 11/58
(52) U.S. Cl. ..... 400/625; 400/680
(58) Field of Search ..... 400/625, 271, 400/624, 630, 691, 693, 690.4, 680

(56) References Cited

U.S. PATENT DOCUMENTS

| | | | | |
|---|---|---|---|---|
| 5,384,586 | * | 1/1995 | Hirano et al. | 346/134 |
| 5,387,043 | * | 2/1995 | Fujioka et al. | 400/691 |
| 5,534,894 | * | 7/1996 | Hirano et al. | 346/134 |
| 5,800,083 | * | 9/1998 | Gaarder et al. | 400/185 |

FOREIGN PATENT DOCUMENTS

| | | |
|---|---|---|
| 63-231965 | 9/1988 | (JP) . |
| 3018057 | 1/1991 | (JP) . |
| 4-45057 | 2/1992 | (JP) . |
| 5005758 | 1/1993 | (JP) . |
| 5-70947 | 9/1993 | (JP) . |
| 6-64822 | 3/1994 | (JP) . |
| 8-81104 | 3/1996 | (JP) . |

* cited by examiner

*Primary Examiner*—John S. Hilten
*Assistant Examiner*—Darius N. Cone
(74) *Attorney, Agent, or Firm*—Foley & Lardner

(57) ABSTRACT

A printer includes a box-like main body cover, an upper cover, a stacker, and stacker attaching means. The main body cover has an opening and stores a printing unit main body. The upper cover is attached to be able to open/close the opening of the main body cover and pivots about a rear end side of the main body cover as an axis. The stacker is attached to a rear end portion of the upper cover to temporarily place a paper sheet thereon. The stacker attaching means supports the stacker to be pivotal in a direction opposite to a pivoting direction of the upper cover.

1 Claim, 6 Drawing Sheets

PRINTER HAVING STACKER

BACKGROUND OF THE INVENTION

The present invention relates to a printer having a stacker for temporarily placing a printed paper sheet on it.

FIGS. 6A to 6C show the operation of a conventional printer.

As shown in FIG. 6A, a conventional printer P0 has a box-like main body cover 1 storing a printing unit main body (not shown), and a thin box-like upper cover 2 attached to the upper surface side of the main body cover 1 to be rotatable about its rear end portion as the center.

The upper cover 2 has a discharge port 2*a* in its upper surface to discharge the paper sheet facedown wherein the printed surface faces downward. As shown in FIG. 6B, a stepped portion 5 is formed on the rear side of the upper cover 2. A discharge port 2*c* is formed in a vertical portion 2*b* of the stepped portion 5 to discharge the paper sheet faceup wherein the printed surface faces upward. A stacker 3 is fixed at a position on a horizontal portion 2*d* of the stepped portion 5 opposing the discharge port 2*c* by a pair of fixing members 4. The stacker 3 is formed of a flat plate member to temporarily place the paper sheet, which has been discharged faceup, on it.

In the conventional printer P0, when the user or the like opens the upper cover 2 by rotating it through about 90°, as indicated by an arrow A in FIG. 6C, to exchange the articles of consumption or to take a countermeasure for solving paper jamming, the stacker 3 is also rotated as indicated by an arrow B together with the upper cover 2 while it is fixed to the upper cover 2, to likely collide against the devices or wall located on its rear side. To prevent this, a large space (dead space) for preventing collision must be kept behind the printer P0.

Such a dead space is not preferable as it increases the area required when using the printer P0.

SUMMARY OF THE INVENTION

It is an object of the present invention to provide a printer which does not require a collision-preventive space on its rear side when the upper cover is opened by rotating it toward the rear side.

In order to achieve the above object, according to the present invention, there is provided a printer comprising a box-like main body cover having an opening to store a printing unit main body, an upper cover attached to be able to open/close the opening of the main body cover and pivotal about a rear end side of the main body cover as an axis, a stacker attached to a rear end portion of the upper cover to temporarily place a paper sheet thereon, and stacker attaching means for supporting the stacker to be pivotal in a direction opposite to a pivoting direction of the upper cover.

DESCRIPTION OF THE PREFERRED EMBODIMENTS

The present invention will be described in detail with reference to the accompanying drawings.

First Embodiment

Figure 1A:
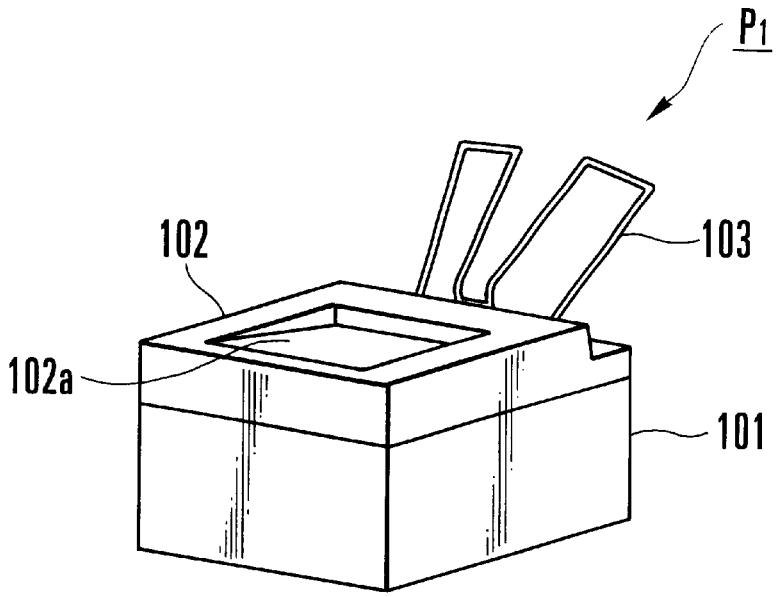
FIGS. 1A and 1B are perspective views seen from the front and rear sides, respectively, of a printer according to the first embodiment of the present invention.
Figure 1B:
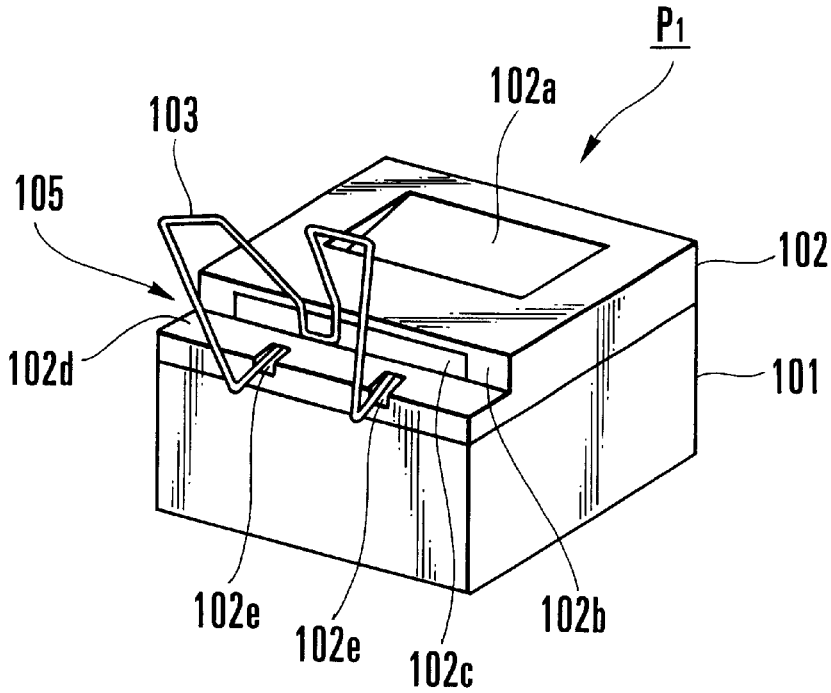

FIGS. 1A and 1B show a printer according to the first embodiment of the present invention from the front and rear sides, respectively.

As shown in FIG. 1A, a printer P1 of this embodiment has a box-like main body cover 101 having an opening to store a printing unit main body (not shown), and a thin box-like upper cover 102 covering the opening of the main body cover 101 and rotatably attached to the rear end portion of the main body cover 101. The main body cover 101 constitutes a lower housing while the upper cover 102 constitutes a pivotal upper housing.

The upper cover 102 has a discharge port 102*a* in its upper surface to discharge the paper sheet facedown. As shown in FIG. 1B, a stepped portion 105 is formed on the rear side of the upper cover 102. A discharge port 102*c* is formed in a vertical portion 102*b* of the stepped portion 105 to discharge the paper sheet faceup. A stacker 103 is detachably attached at a position on a horizontal portion 102*d* of the stepped portion 105 opposing the discharge port 102*c*. The stacker 103 is formed of an elastic bent portion made of a synthetic resin to temporarily place the paper sheet, which has been discharged faceup, on it.

Figure 2A:
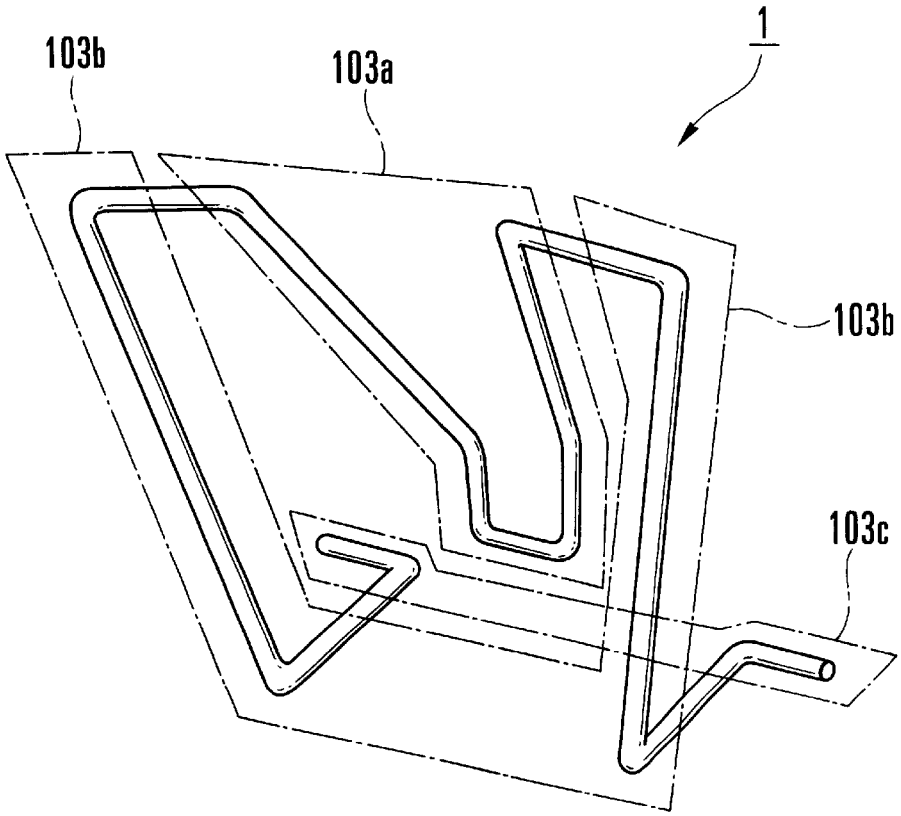
FIG. 2A is a perspective view seen from the rear side of a stacker shown in FIGS. 1A and 1B.

The stacker 103 forms a substantially M shape. As shown in FIG. 2A, a central V-shaped portion 103*a* surrounded by an alternate long and a short dashed line projects toward the discharge portion 102*c* (the counter-pivoting direction of the upper cover 102) to constitute a paper sheet receiving portion for receiving the discharged paper sheet. A pair of vertical portions 103*b* connected to the two sides of the V-shaped portion 103*a* and surrounded by an alternate long and a short dashed line constitute a stacker main body.

The pair of vertical portions 103*b* are bent in the same direction as the projecting direction of the V-shaped portion 103*a* at their lower portions. Bent portions 103*c* respectively formed by further bending the vertical portions 103*b* outward (in the direction of rotation axis of the upper cover) at their distal end sides constitute part of a reversely rotatable attaching means.

Figure 2B:
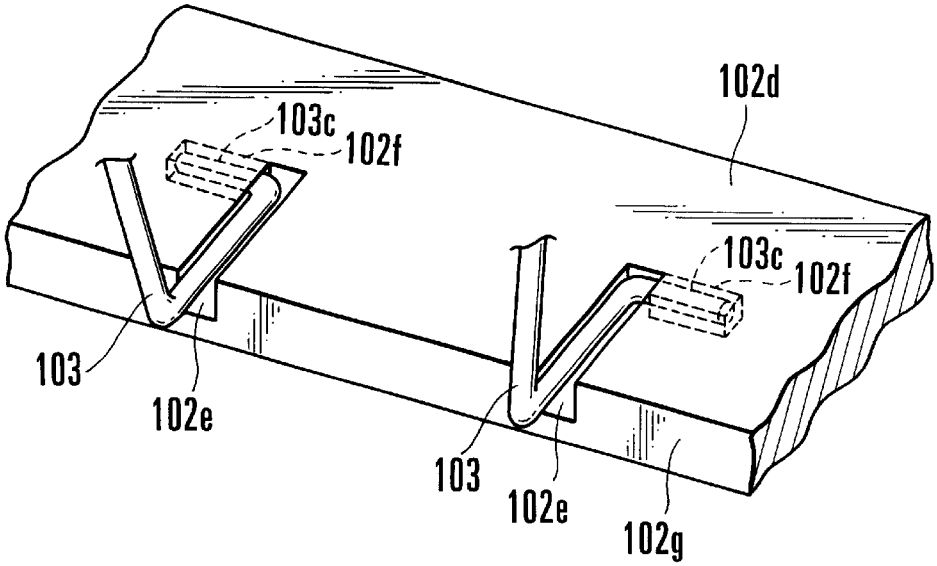
FIG. 2B is an enlarged perspective view of the printer attaching portion of the stacker shown in FIGS. 1A and 1B.

On the horizontal portion 102*d* of the upper cover 102, as shown in FIG. 2B, two notched grooves 102*e* that open to a rear end face 102*g* are formed parallel to each other at a predetermined distance. Bearing holes 102*f* where the bent portions 103*c* of the stacker 103 are rotatably inserted are formed in the distal end portions of the notched grooves 102*e*. The bearing holes 102*f* and the bent portions 103*c* of the stacker 103 constitute a stacker attaching means.

An opening/closing operation of the upper cover 102 of this embodiment will be described with reference to FIGS. 3A to 3C.

Figure 3A:
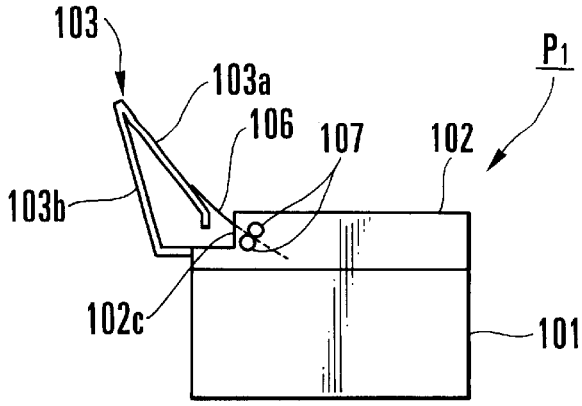
FIG. 3A is a view showing a case wherein a paper sheet is being discharged from the printer shown in FIGS. 1A and 1B.

FIG. 3A shows a normal use state of the printer P1. A printed paper sheet 106 is pushed out and discharged from the discharge portion 102*c* by rotation of discharge rollers 107, and goes upward along the paper sheet receiving portion 103*a* of the stacker 103 to be stacked on the stacker 103. In this case, a sufficiently large space is kept on the rear side of the printer P1.

Figure 3B:
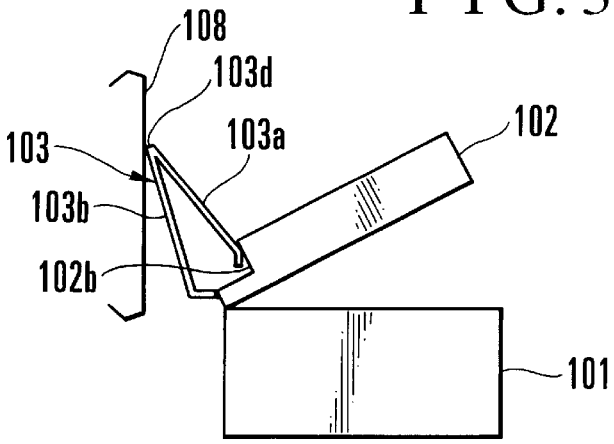
FIG. 3B is a view showing a case wherein the upper cover is slightly opened.

FIG. 3B shows a case wherein a wall 108 is present near the rear side of the printer P1. When the upper cover 102 is pivoted toward the rear side (counterclockwise direction in FIG. 3B) of the printer in order to exchange the articles of consumption or to cope with paper sheet jamming, a distal end portion 103*d* of the stacker 103 first abuts against the wall 108. As the stacker 103 is supported by the bearing holes 102*f* of the upper cover 102 to be pivotal about the bent portions 103*c* as the axis, the upper cover 102 continues the pivot operation while the stacker 103 is kept in contact with the wall 108. In response to the pivot operation of the upper cover 102, the stacker 103 pivots about the bent portions 103*c* as the center. After that, the vertical portion 102*b* of the upper cover 102 abuts against the stacker 103 which is kept in contact with the wall 108.

Figure 3C:
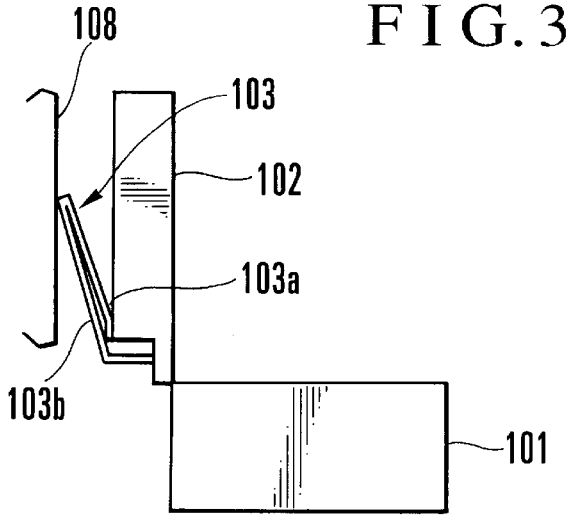
FIG. 3C shows a case wherein the upper cover is opened through about 90°.

When the upper cover 102 is further pivoted to almost the vertical position, as shown in FIG. 3C, the upper surface portion of the stacker 103 abuts against the paper sheet receiving portion 103*a* of the stacker 103. Since it is constituted by an elastic member, the paper sheet receiving 103*a* is pivoted clockwise in FIG. 3C about its portions connected to the vertical portions 103*b* as the axis and is pushed between the vertical portions 103*b*. As a result, the upper cover 102 can be opened by rotating it till about 90°, at which a sufficiently large opening can be formed, without increasing the projection area of the stacker 103.

Second Embodiment

Figure 4A:
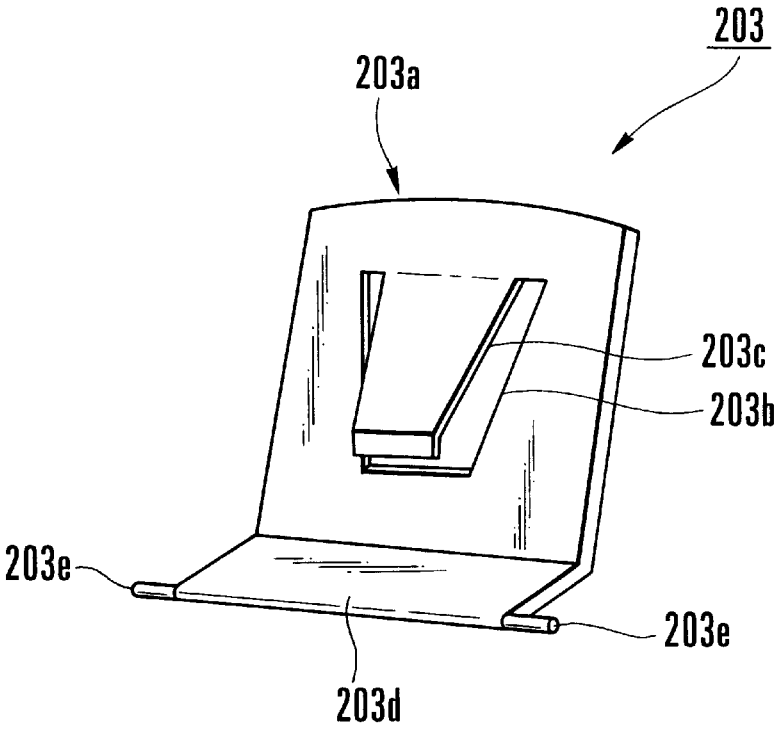
FIG. 4A is a perspective view seen from the front side of a stacker according to the second embodiment of the present invention.

FIG. 4A shows a stacker according to the second embodiment from the front side of a printer.

A stacker 203 has a stacker main body 203*a* made of an elastic material such as a synthetic resin into a substantially square plate, and a tongue-like paper sheet receiving portion 203*c*. The paper sheet receiving portion 203*c* is formed by notching the center of the stacker main body 203*a* at a notched portion 203*b* to project forward (in the counter-pivoting direction of an upper cover 102). The paper sheet receiving portion 203*c* is connected to the upper portion of the notched portion 203*b* of the stacker main body 203*a*.

Figure 4B:
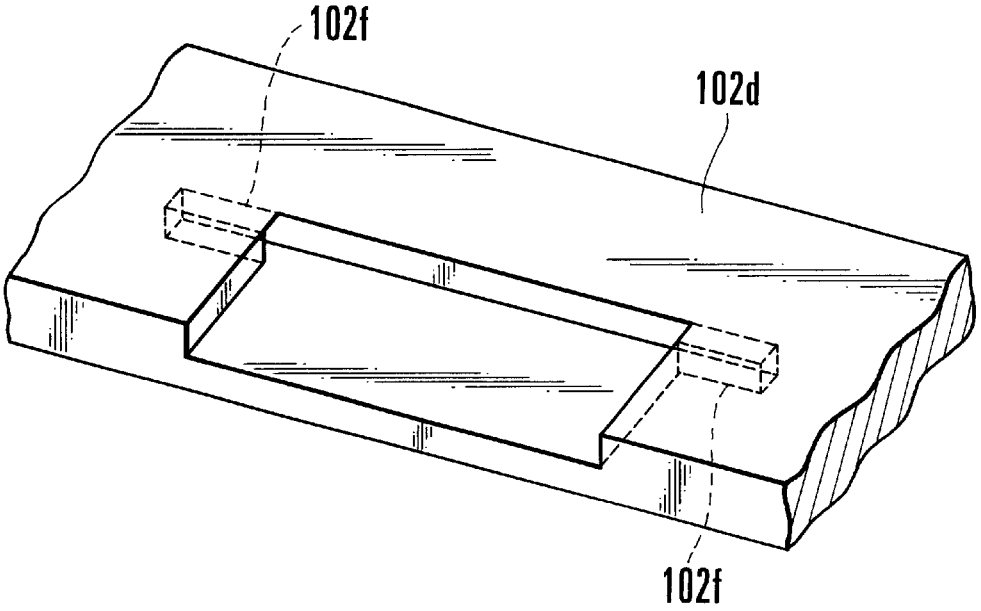
FIG. 4B is an enlarged perspective view of the printer attaching portion of the stacker shown in FIG. 4A.

The stacker main body 203*a* is bent forward at its lower portion, and this bent portion consitutes a rest portion 203*d* to be placed on a horizontal portion 102*d* (FIG. 1B) of the upper cover 102. A pair of end shafts 203*e* are formed at the distal end portions of the two end faces of the rest portion 203*d* to extend in the direction of the rotation axis of the upper cover 102. As shown in FIG. 4B, these end shafts 203*e* are rotatably inserted in bearing holes 102*f* formed in the horizontal portion 102*d* of the upper cover 102.

In this arrangement as well, when the upper cover 102 is opened by rotating it, the stacker 203 which has abutted against the wall or the like is first rotated about the end shafts 203*e* as the center. When the upper cover 102 is further rotated, it pushes the paper sheet receiving portion 203*c* into the notched portion 203*b*. Therefore, the upper cover 102 can be opened sufficiently, in the same manner as in FIG. 3C.

Third Embodiment

Figure 5:
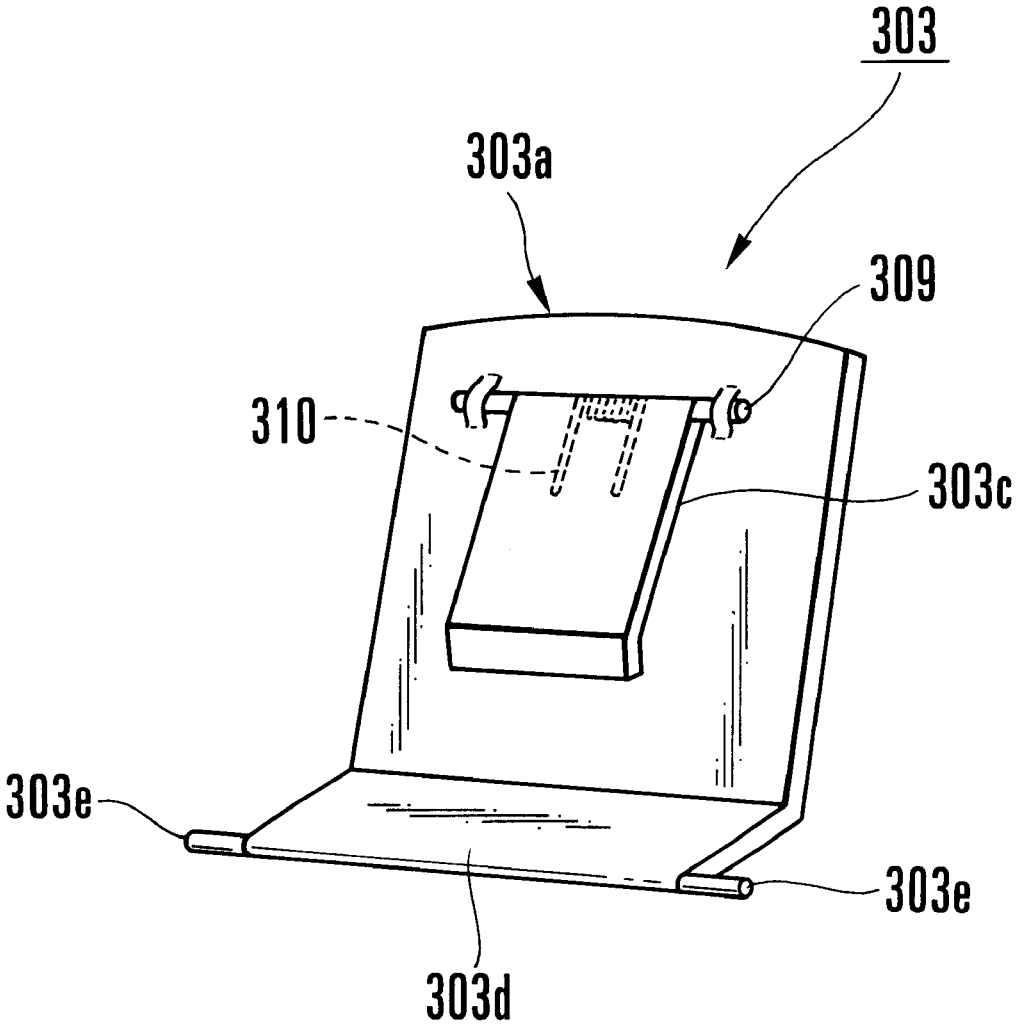
FIG. 5 is a perspective view seen from the front side of a stacker according to the third embodiment of the present invention.
Figure 6A:
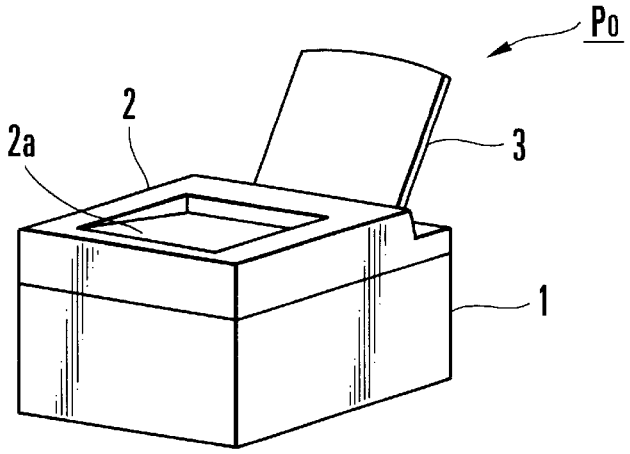
FIG. 6A PRIOR ART
FIGS. 6A and 6B are perspective views seen from the front and rear sides, respectively, of a conventional printer.
Figure 6B:
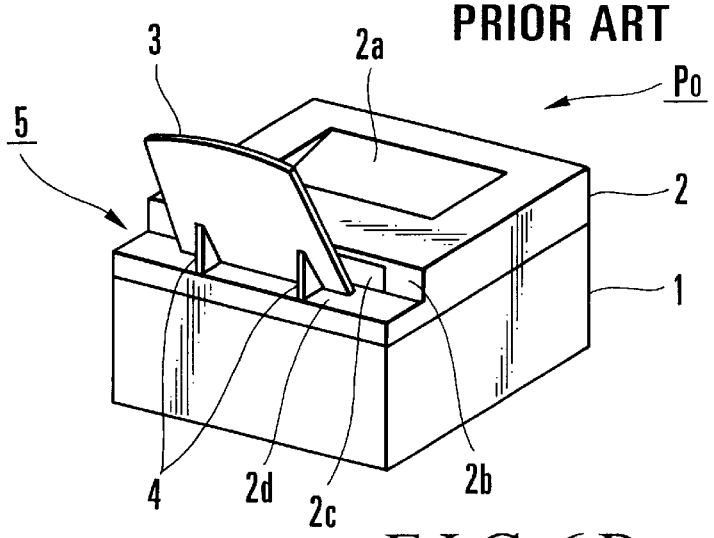
FIG. 6B PRIOR ART
Figure 6C:
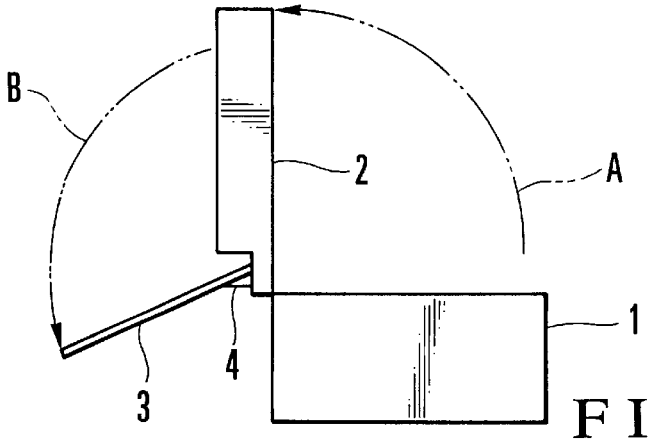
FIG. 6C PRIOR ART
FIG. 6C is a view showing a case wherein the upper cover of a conventional printer is opened.

FIG. 5 shows a stacker according to the third embodiment from the front side of the printer.

A stacker 303 has a substantially square stacker main body 303*a* made of a synthetic resin, and a tongue-like paper sheet receiving portion 303*c*. The paper sheet receiving portion 303*c* is pivotally mounted on a support shaft 309 attached to the stacker main body 303*a*. The paper sheet receiving portion 303*c* is biased forward, i.e., the counter-pivoting direction of the upper cover, by a biasing member 310, e.g., a coil spring, arranged on its lower side.

The stacker main body 303*a* is bent forward at its lower portion, and this bent portion constitutes a rest portion 303*d* to be placed on a horizontal portion 102*d* (FIG. 1B) of an upper cover 102. A pair of end shafts 303*e* are formed at the distal end portions of the two end faces of the rest portion 303*d* to extend in the direction of the rotation axis of the upper cover 102. The stacker 303 formed in this manner is attached to the upper cover 102 as shown in FIG. 4B, in the same manner as in the second embodiment.

In this arrangement, in the same manner as in the second embodiment, when the upper cover 102 is opened by rotating it, the stacker 303 which has abutted against the wall or the like is pivoted about the end shafts 203*e* as the center. When the upper cover 102 abuts against the stacker 303, it pushes the paper sheet receiving portion 303*c* of the stacker 303 against the biasing force. Therefore, the upper cover 102 can be opened sufficiently.

The above embodiments exemplify printers that perform printing on the paper sheet. The present invention can also be applied to an apparatus, e.g., a copying apparatus or a facsimile apparatus, which has a stacker for temporarily placing on it a paper sheet discharged from the apparatus main body, as a matter of course.

As has been described above, according to the present invention, when the upper cover is opened by rotating it toward the rear side in order to exchange the articles of consumption or to eliminate paper sheet jamming, the stacker is rotated in a direction opposite to the rotating direction of the upper cover by the reversely rotatable attaching means, so that the projection area of the stacker on the floor can be reduced. A printer that does not require a collision-preventive space on its rear side can thus be provided.

What is claimed is:

1. A printer comprising:

a box-like main body cover having an opening to store a printing unit main body;

an upper cover attached to be able to open/close said opening of said ma in body cover and pivotal about a rear end side of said main body cover as an axis;

a stacker attached to a rear end portion of said upper cover to temporarily place a paper sheet thereon; and stacker attaching means for supporting said stacker to be pivotal in a direction opposite to a pivoting direction of said upper cover;

wherein said stacker comprises a stacker main body portion provided with said stacker attaching means, and a paper sheet receiving portion connected to said stacker main body portion to be abutted by the paper sheet, and said paper sheet receiving portion displaces in the pivoting direction of said upper cover when being abutted by said pivoted upper cover, wherein said stacker main body portion is formed of an elastic plate member, and said paper sheet receiving portion is formed of a tongue-like member formed by notching a central portion of said plate member to project in a counter-pivoting direction of said upper cover.

* * * * *